US006877475B2

(12) United States Patent
Nishida et al.

(10) Patent No.: US 6,877,475 B2
(45) Date of Patent: Apr. 12, 2005

(54) FUEL CUT-OFF DEVICE FOR ENGINE

(75) Inventors: Kazutomo Nishida, Saitama (JP); Mitsuyoshi Kanai, Saitama (JP); Yasushi Fujita, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/624,093

(22) Filed: Jul. 21, 2003

(65) Prior Publication Data

US 2004/0094116 A1 May 20, 2004

(30) Foreign Application Priority Data

Jul. 26, 2002 (JP) ..... 2002-217764

(51) Int. Cl.[7] ..... F02P 9/00
(52) U.S. Cl. ..... 123/198 DB; 123/198 F
(58) Field of Search ..... 123/198 DB, 198 F

(56) References Cited

U.S. PATENT DOCUMENTS 5,062,400 A * 11/1991 Minegishi ..... 123/198 DB
5,282,447 A * 2/1994 Kubota ..... 123/198 DB
5,301,644 A * 4/1994 Olmr ..... 123/198 DB
5,441,025 A * 8/1995 Ryberg ..... 123/198 DB
5,765,522 A * 6/1998 Tagami ..... 123/198 DB
5,797,374 A * 8/1998 Minagawa et al. ..... 123/497
5,878,710 A * 3/1999 Ritter et al. ..... 123/198 DB
6,615,792 B1 * 9/2003 Grifka et al. ..... 123/198 DB

FOREIGN PATENT DOCUMENTS

JP 60-175841 11/1985

* cited by examiner

*Primary Examiner*—Noah P. Kamen
*Assistant Examiner*—Jason Benton
(74) *Attorney, Agent, or Firm*—Carrier Blackman & Associates, P.C.; Joseph P. Carrier; William D. Blackman

(57) ABSTRACT

In a fuel cut-off device for an engine in which one of a plurality of generating coils of a generator is connected to a normally-opened type solenoid valve adapted to block a fuel passage in a carburetor upon energization of the solenoid valve through an engine control switch adapted to be operated to a turned-off position and a turned-on position so that the solenoid valve can be energized from the one generating coil in the turned-off position of the switch, an output from the one generating coil is supplied to an electric load in the turned-on position of the engine control switch, together with outputs from the other generating coils. Thus, during operation of the engine, also the output from the one generating coil conventionally prepared for cutting off fuel is effectively supplied to the electric load, together with the outputs from the other generating coils, whereby the generating performance of the generator can be enhanced.

8 Claims, 3 Drawing Sheets

FIG.3

CONNECTION TABLE FOR ENGINE CONTROL SWITCH

| OPERATED POSITION \ STATIONARY CONTACT | CHG | SOL | IG | E | BAT | LO | ST |
|---|---|---|---|---|---|---|---|
| A | ○ | ○ | ○ | ○ | | | |
| B | ○ | | | | ○ | ○ | |
| C | ○ | | | | ○ | ○ | ○ |

FUEL CUT-OFF DEVICE FOR ENGINE

BACKGROUND OF THE INVENTION

1. Field of the Invention

The present invention relates to an improvement in a fuel cut-off device for an engine, in which one of a plurality of generating coils provided in a generator driven by an engine is connected to a normally-opened type solenoid valve adapted to block a fuel passage in a carburetor during energization of the solenoid valve, through an engine control switch adapted to be operated to a turned-off position in which an engine ignition device is brought into an inoperative state and a turned-on position in which said engine ignition device is brought into an operative state, thereby supplying an output from said one generating coil to said solenoid valve in the turned-off position of said engine control switch.

2. Description of the Related Art

As disclosed, for example, in Japanese Utility Model Application Laid-open No. 60-175841, a conventional fuel cut-off device for the engine is designed so that when the engine control switch is operated to the turned-off position, the fuel passage in the carburetor is blocked by the solenoid valve by utilizing the output from the one generating coil provided by the inertial rotation of the engine, thereby immediately stopping the supplying of the fuel to the engine to prevent a dieseling phenomenon caused by the inertial rotation of the engine.

In the conventional known fuel cut-off device for the engine, the output from the one generating coil is used only to operate the solenoid valve adapted to block the fuel passage in the carburetor when the operation of the engine is stopped. Therefore, during operation of the engine, the one generating coil is brought into a suspended state.

SUMMARY OF THE INVENTION

Accordingly, it is an object of the present invention to provide a fuel cut-off device for an engine, wherein the output from the one generating coil can also be effectively supplied to an electric load, together with outputs from the other generating coils, during operation of the engine, whereby the generating performance of the generator can be enhanced.

To achieve the above object, according to the present invention, there is provided a fuel cut-off device for an engine, in which one of a plurality of generating coils provided in a generator driven by an engine is connected to a normally-opened type solenoid valve adapted to block a fuel passage in a carburetor during energization of the solenoid valve, through an engine control switch adapted to be operated to a turned-off position in which an engine ignition device is brought into an inoperative state and a turned-on position in which said engine ignition device is brought into an operative state, thereby supplying an output from said one generating coil to said solenoid valve in the turned-off position of said engine control switch, wherein said engine control switch is constructed so that the output from said one generating coil can be supplied to an electric load, together with outputs from the other generating coils in the turned-on position of said engine control switch.

With this feature, during operation of the engine with the engine control switch brought into the turned-on position, the output from the one generating coil conventionally prepared for cutting-off of fuel is also supplied to drive the external load, together with outputs from the other generating coils. Therefore, the electric load can be strongly driven without increasing the size of the generator or increasing the number of the generating coils.

The above and other objects, features and advantages of the invention will become apparent from the following description of the preferred embodiment taken in conjunction with the accompanying drawings.

BRIEF DESCRIPTION OF THE DRAWINGS

FIG. 3 is a connection table for an engine control switch in the electric circuit.

DESCRIPTION OF THE PREFERRED EMBODIMENT

The present invention will now be described by way of a preferred embodiment with reference to the accompanying drawings.

Figure 1:
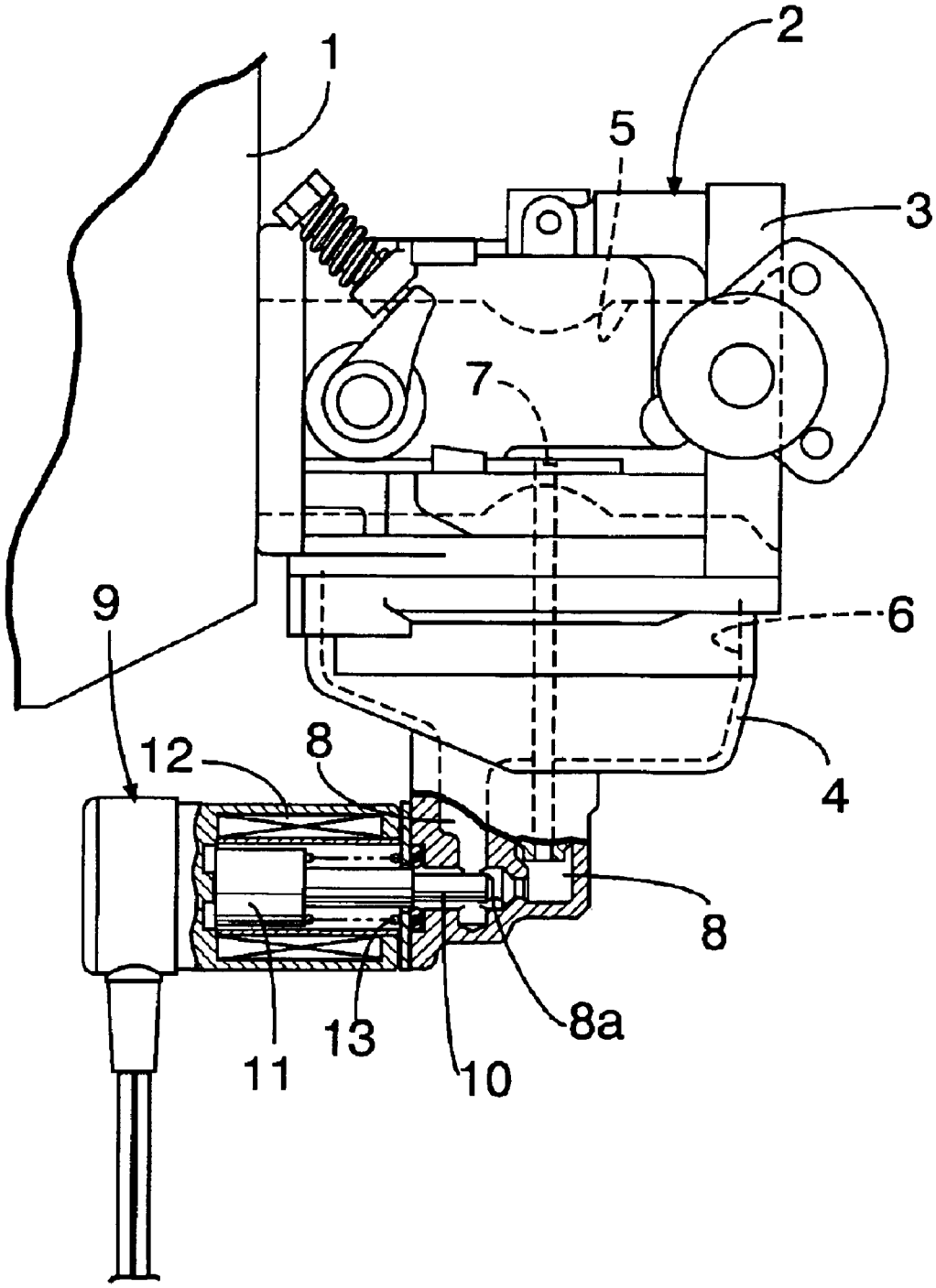
FIG. 1 is a side view of a carburetor including a cutaway view of a solenoid valve portion of a fuel cut-off device according to the present invention.

Referring first to FIG. 1, a carburetor 2 mounted to an engine 1 is comprised of a carburetor body 3 having an intake passage 5 leading to an intake port of the engine 1, and a float chamber member 4 having a float chamber 6 which constantly stores a certain amount of fuel supplied from a fuel tank (not shown). A fuel passage 8 is formed in the float chamber member 4, and supplies the fuel in the float chamber 6 to a fuel nozzle 7 opening into the intake passage 5. A solenoid valve 9 for opening and closing the fuel passage 8 is mounted to the float chamber member 4.

The solenoid valve 9 is a normally-opened type, and includes: a valve member 10 mounted to be opposed to a valve seat 8*a* formed in the middle of the fuel passage 8; a movable core 11 connected to the valve member 10; a solenoid 12 surrounding the movable core 11 for driving the movable core 11 so that the valve member 10 is seated on the valve seat 8*a* upon energization of the solenoid 12; and a return spring 13 for biasing the movable core 11 in a direction away from the valve seat 8*a* for the valve member 10. Therefore, the solenoid valve 9 is adapted to cause the valve member 10 to be moved away from the valve seat 8*a* to open the fuel passage 8 during non-energization of the solenoid 12, and to cause the valve member 10 to be seated on the valve seat 8*a* to block the fuel passage 8 upon energization of the solenoid 12.

Figure 2:
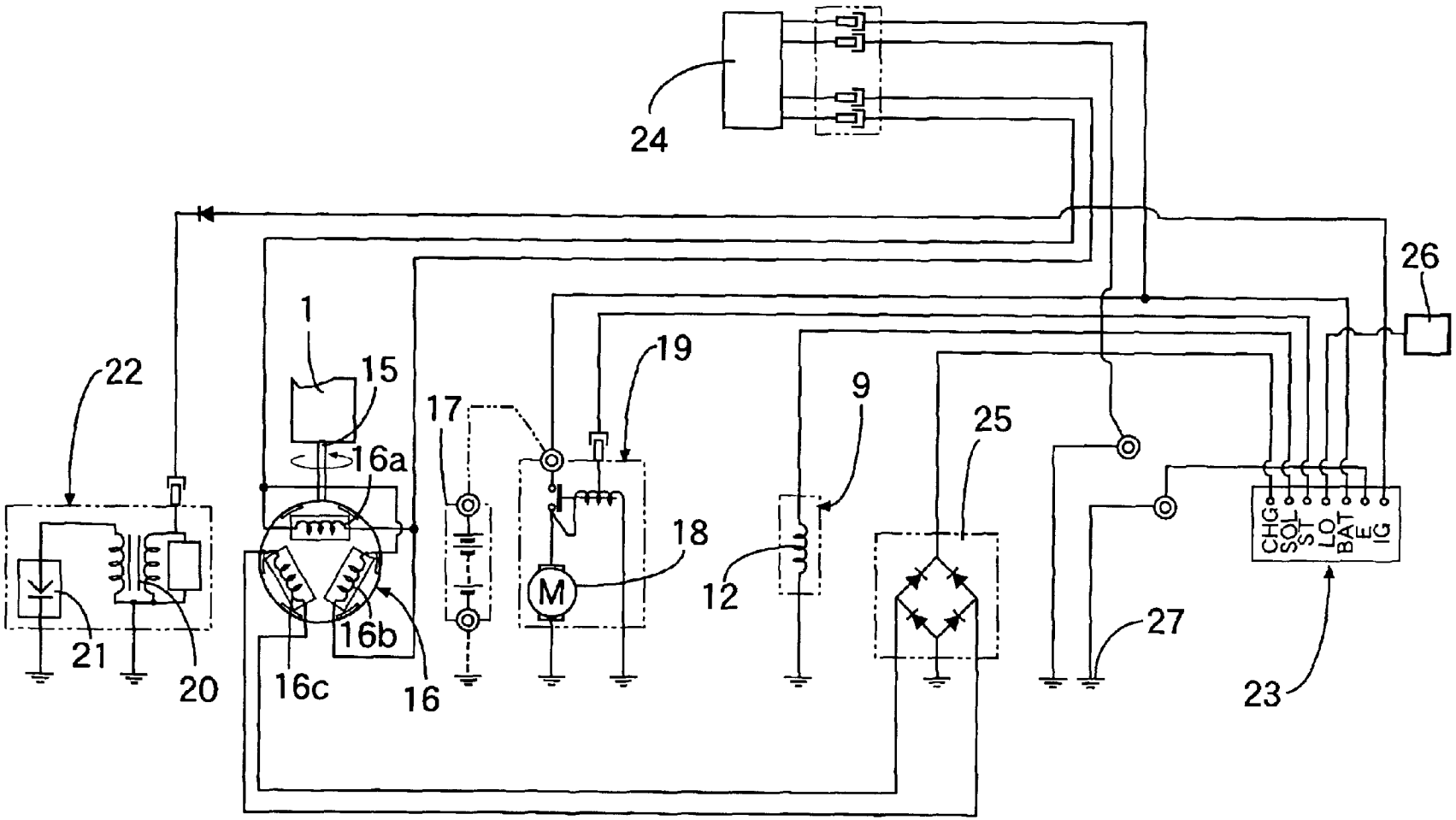
FIG. 2 is a diagram of an electric circuit for the engine including the solenoid valve.

As shown in FIG. 2, the solenoid valve 9 is incorporated in an electric circuit for the engine.

The electric circuit for the engine includes: an AC generator 16 driven by rotation of a crankshaft 15 of the engine 1; a battery 17; a starting device 19 including a starter motor 18; an ignition device 22 including an ignition coil 20 and a spark plug 21; the solenoid valve 9; and an engine control switch 23.

The generator 16 includes a plurality of (three in the illustrated embodiment) generating coils 16*a*, 16*b*, and 16*c*. Outputs from the generating coils 16*a* and 16*b* are supplied to the battery 17 and an electric load 26 through a first rectifier 24 having a voltage-regulating function, but an output from the generating coil 16*c* is selectively supplied to the solenoid 12 of the solenoid valve 9 or the battery 17 and the electric load 26 through a second rectifier 25 and further the engine control switch 23. The electric load 26 includes an external load such as a working electric motor and internal loads such as various indicators.

The engine control switch 23 has three operational positions: a turned-off position A, a turned-on position B and a start position C, and has stationary contacts: a charging contact CHG, a solenoid contact SOL, a starting contact ST, an earth contact E, a battery contact BAT, a load contact LO, and an ignition contact IG. An output portion of the second rectifier 25 is connected to the charging contact CHG; the solenoid 12 is connected to the solenoid contact SOL; the starting device 19 is connected to the starting contact ST; the electric load 26 is connected to the load contact LO; the battery 17 is connected to the battery contact BAT; a ground 27 is connected to the earth contact E; and the ignition device 22 is connected to the ignition contact IG.

The engine control switch 23 is adapted to provide connection among the stationary contacts CHG to IG, in accordance with Connection Table shown in FIG. 3 through a movable contact (not shown), in response to the operation of the switch 23 to the turned-off position A, the turned-on position B and the start position C.

More specifically, in the turned-off position A of the engine control switch 23, the charging contact CHG and the solenoid contact SOL are connected to each other, and the ignition contact IG and the earth contact E are connected to each other. As a result, the ignition device 22 is brought into an inoperative state by the grounding, whereby the engine 1 is brought into an inoperable state. At that time, if the crankshaft 15 of the engine 1 is inertially rotated along with the generator 16, the output from the one generating coil 16*c* is supplied to the solenoid 12 of the solenoid valve 9 through the second rectifier 25, so that the movable core 11 is operated against the biasing force of the return spring 13 by a magnetic force generated by the solenoid 12, thereby causing the valve member 10 to be seated on the valve seat 8*a* to block the fuel passage 8 in the carburetor 2. Therefore, the injection of the fuel from the fuel nozzle 7 is immediately stopped and the intake of the fuel into the engine 1 inhibited, so that a dieseling phenomenon of the engine 1 is prevented.

In the turned-on position B of the engine control switch 23, the ignition contact IG and the earth contact E are disconnected from each other, and the charging contact CHG and the solenoid contact SOL are disconnected from each other, while the charging contact CHG is connected to the battery contact BAT and the load contact LO. As a result, the solenoid valve 9 enters a non-energized state to open, thereby opening the fuel passage 8 in the carburetor 2, so that the carburetor 2 normally functions to enable the operation of the engine 1. During operation of the engine 1, the output from the one generating coil 16*c* is supplied to the battery 17 and the electric load 26 together with the outputs from the other generating coils 16*a* and 16*b*. In this way, the outputs from all the generating coils 16*a*, 16*b* and 16*c* are effectively taken out to be used. Therefore, the charging of the battery and the driving of the electric load 26 can be sufficiently carried out without increasing the size of the generator 16 or increasing the number of the generating coils.

Further, in the start position C of the engine control switch 23, the charging contact CHG and the starting contact ST are also connected to each other in addition to the state in the turned-on position B. Therefore, the output from the one generating coil 16*c* is supplied to the battery 17 and the starting device 19 together with the outputs from the other generating coils 16*a* and 16*b*, so that the starter motor 18 can be strongly activated to easily start the engine.

The present invention is not limited to the above-described embodiment, and various modifications in design may be made without departing from the subject matter of the present invention.

What is claimed is:

1. A fuel cut-off device for an engine, in which one of a plurality of generating coils provided in a generator driven by an engine is connected to a normally-opened type solenoid valve adapted to block a fuel passage in a carburetor during energization of the solenoid valve, through an engine control switch adapted to be operated to a turned-off position in which an engine ignition device is brought into an inoperative state and a turned-on position in which said engine ignition device is brought into an operative state, thereby supplying an output from said one generating coil to said solenoid valve in the turned-off position of said engine control switch, wherein said engine control switch is constructed so that the output from said one generating coil is supplied to an electric load, together with outputs from the other generating coils in the turned-on position of said engine control switch.

2. The fuel cut-off device according to claim 1, wherein the output from said one generating coil is selectively supplied to the solenoid valve, a battery and the electrical load through a rectifier and said engine control switch.

3. The fuel cut-off device according to claim 2, wherein the outputs from said other generating coils are selectively supplied to the battery and the electrical load through another rectifier and said engine control switch.

4. The fuel cut-off device according to claim 1, wherein said solenoid valve includes a valve member which engages with a seat of the fuel passage in the carburetor during energization of the solenoid valve.

5. A control system for an engine and a generator driven by the engine is, comprising:

an engine ignition device;

an engine control switch adapted to be operated to a turned-off position in which said engine ignition device is brought into an inoperative state and a turned-on position in which said engine ignition device is brought into an operative state;

a carburetor;

a normally-opened type solenoid valve adapted to block a fuel passage in said carburetor during energization of the solenoid valve;

wherein said generator includes multiple generating coils;

said engine control switch supplying an output from one of said generating coils to said solenoid valve in the turned-off position of said engine control switch; and said engine control switch supplying outputs from all of said generating coils to an electric load in the turned-on position of said engine control switch.

6. The control system for an engine according to claim 5, wherein the output from said one generating coil is selectively supplied to the solenoid valve, a battery and the electrical load through a rectifier and said engine control switch.

7. The control system for an engine according to claim 6, wherein the outputs from said generating coils other than said one generating coil are selectively supplied to the battery and the electrical load through another rectifier and said engine control switch.

8. The fuel cut-off device according to claim 5, wherein said solenoid valve includes a valve member which engages with a seat of the fuel passage in the carburetor during energization of the solenoid valve.

* * * * *

UNITED STATES PATENT AND TRADEMARK OFFICE

CERTIFICATE OF CORRECTION

PATENT NO. : 6,877,475 B2
DATED : April 12, 2005
INVENTOR(S) : Kazutomo Nishida et al.

It is certified that error appears in the above-identified patent and that said Letters Patent is hereby corrected as shown below:

Column 3,
Line 36, change “inhibited,” to -- is inhibited, --.

Column 4,
Line 32, change “engine is, comprising:” to -- engine, comprising: --.

Signed and Sealed this

Eleventh Day of October, 2005

JON W. DUDAS
*Director of the United States Patent and Trademark Office*